US008851927B2

(12) United States Patent
Hsu et al.

(10) Patent No.: US 8,851,927 B2
(45) Date of Patent: Oct. 7, 2014

(54) ELECTRICAL CONNECTOR WITH SHIELDING AND GROUNDING FEATURES THEREOF

(71) Applicants: Kuo-Chun Hsu, New Taipei (TW); Terrance F. Little, Fullerton, CA (US); Yu-Hsu Chen, New Taipei (TW); Chien-Ping Kao, Hershey, PA (US)

(72) Inventors: Kuo-Chun Hsu, New Taipei (TW); Terrance F. Little, Fullerton, CA (US); Yu-Hsu Chen, New Taipei (TW); Chien-Ping Kao, Hershey, PA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 62 days.

(21) Appl. No.: 13/757,740

(22) Filed: Feb. 2, 2013

(65) Prior Publication Data

US 2014/0220827 A1 Aug. 7, 2014

(51) Int. Cl.
*H01R 13/648* (2006.01)
*H01R 12/52* (2011.01)

(52) U.S. Cl.
CPC ..... *H01R 12/52* (2013.01)
USPC ..... 439/607.11

(58) Field of Classification Search
USPC ..... 439/607.08–607.11
See application file for complete search history.

(56) References Cited

U.S. PATENT DOCUMENTS

| | | | | |
|---|---|---|---|---|
| 4,824,383 | A * | 4/1989 | Lemke | 439/108 |
| 6,540,559 | B1 * | 4/2003 | Kemmick et al. | 439/607.05 |
| 6,595,801 | B1 * | 7/2003 | Leonard et al. | 439/607.55 |
| 7,128,611 | B2 | 10/2006 | Tanaka | |
| 7,179,127 | B2 * | 2/2007 | Shiu | 439/607.35 |
| 7,670,156 | B2 * | 3/2010 | Chen | 439/108 |
| 7,758,379 | B2 * | 7/2010 | Chen | 439/607.11 |
| 8,109,795 | B2 * | 2/2012 | Lin et al. | 439/660 |
| 8,262,411 | B2 | 9/2012 | Kondo | |
| 8,475,216 | B2 * | 7/2013 | Tung et al. | 439/660 |
| 8,684,769 | B2 * | 4/2014 | Kao et al. | 439/607.28 |
| 2010/0267261 | A1 * | 10/2010 | Lin et al. | 439/218 |
| 2011/0159747 | A1 * | 6/2011 | Tung et al. | 439/660 |
| 2013/0316581 | A1 * | 11/2013 | Kao et al. | 439/607.28 |
| 2014/0017921 | A1 * | 1/2014 | Hsu | 439/166 |
| 2014/0113481 | A1 * | 4/2014 | Little et al. | 439/374 |

* cited by examiner

*Primary Examiner* — Ross Gushi
(74) *Attorney, Agent, or Firm* — Wei Te Chung; Ming Chieh Chang

(57) ABSTRACT

An electrical connector for mating with a plug and mounting to a printed circuit board, includes an insulative housing defining a rear base and a front mating tongue, two rows of terminals received in the insulating housing and a shielding plate interposed between said two rows of the terminals. The terminals include contacting portions exposed upon opposite surfaces of the front mating tongue and board-connecting legs extending out of the rear base for mounting to the printed circuit board. The terminals are categorized with differential pairs of signal and grounding terminals mixed up with one another for coupling to the plug. The shielding plate includes at least one grounding finger split therefrom and a grounding leg for mounting to the printed circuit board. Each grounding finger is disposed between two adjacent differential pairs and parallel to the contacting portions of said terminals.

20 Claims, 8 Drawing Sheets

ELECTRICAL CONNECTOR WITH SHIELDING AND GROUNDING FEATURES THEREOF

BACKGROUND OF THE INVENTION

1. Field of the Invention

The present invention relates to an electrical connector, and more particularly to an I/O receptacle connector. The invention is related to the copending application Ser. No. 13/479,289 filed May 24, 2012.

2. Description of Related Art

A connector capable of transmitting high-speed differential signals is used as an interface connector or an internal connector of a digital appliance or a PC. Such connector includes a plurality of signal contacts and a plurality of ground contacts. The signal contacts are paired in order to transmit differential signals in the manner known in the art. Generally, on the side of a fitting portion or a contacting portion side of the connector is fitted to or contacted with a mating connector. On the other hand, on the terminal portion side of the contacts to be connected to a board, the terminal portions are arranged in a plurality of rows because the terminal portions are inserted into a plurality of through holes, respectively.

At present, transmission of high-speed differential signals is required in a growing number of software applications. Under the circumstances, there is a demand for an improved connector having a compact size, a low piece, and excellent high-frequency characteristics.

SUMMARY OF THE INVENTION

Accordingly, the object of the present invention is to provide an electrical connector with an improved shielding and grounding feature.

In order to achieve the above-mentioned object, an electrical connector for mating with a plug and mounting to a printed circuit board, comprises an insulative housing defining a rear base and a front mating tongue, two rows of terminals received in the insulating housing and a shielding plate interposed between said two rows of the terminals. The terminals comprise contacting portions exposed upon opposite surfaces of the front mating tongue and board-connecting legs extending out of the rear base for mounting to the printed circuit board. The terminals are categorized with differential pairs of signal and grounding terminals mixed up with one another for coupling to the plug. The shielding plate includes at least one grounding finger split therefrom and a grounding leg for mounting to the printed circuit board. Each of the at lease one grounding finger is disposed between two adjacent differential pairs and parallel to the contacting portions of said terminals.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the first preferred embodiment of the present invention.

Figure 1:
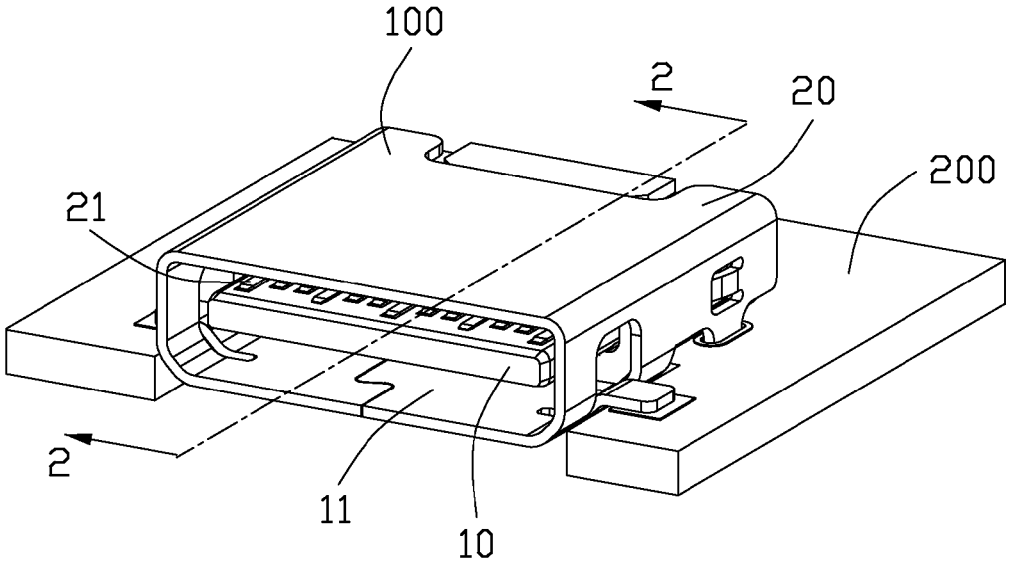
FIG. 1 is a perspective view of an electrical connector in accordance with an embodiment of the present invention, which is mounted on a printed circuit board.
Figure 2:
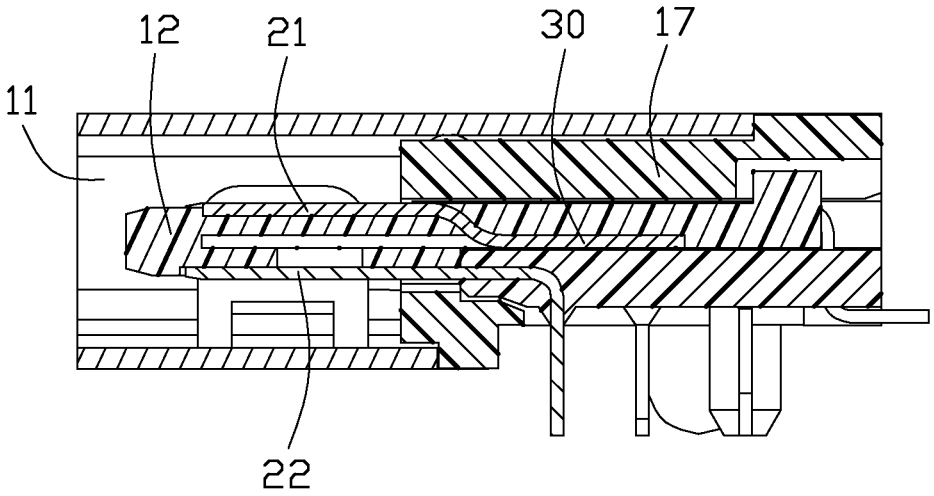
FIG. 2 is a cross-sectional view of the electrical connector of FIG. 1 taken along lines 2-2.
Figure 3:
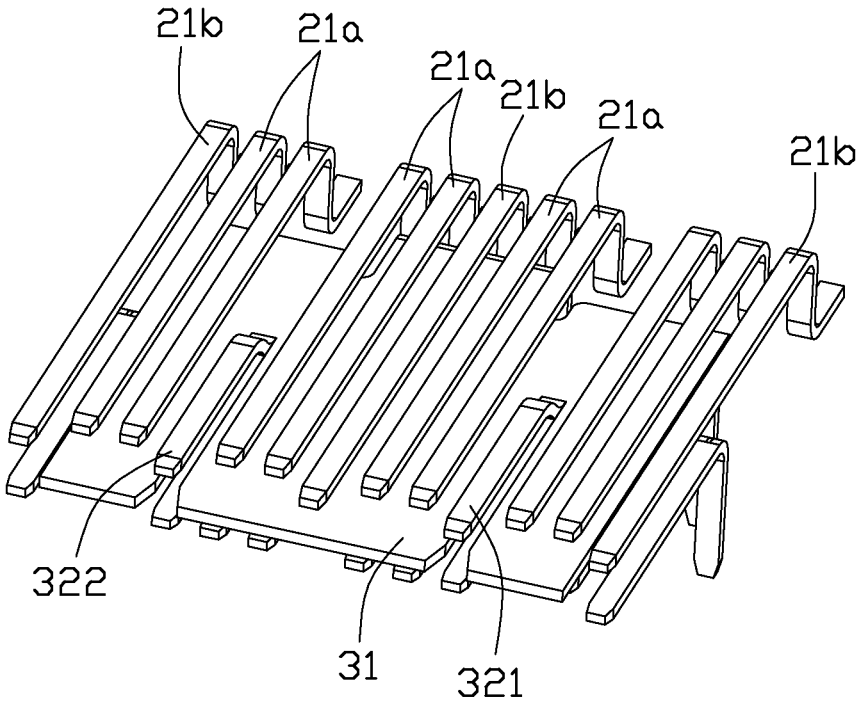
FIG. 3 is a perspective view showing an arrangement of terminals and a shielding plate of the electrical connector.
Figure 4:
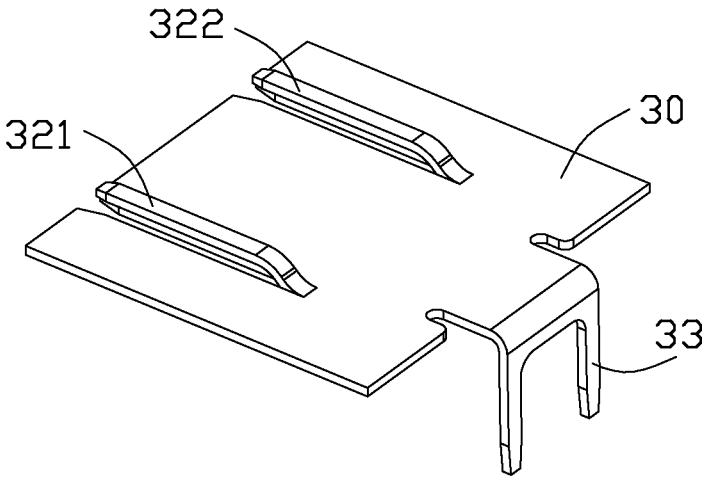
FIG. 4 is a perspective view of the shielding plate.
Figure 5:
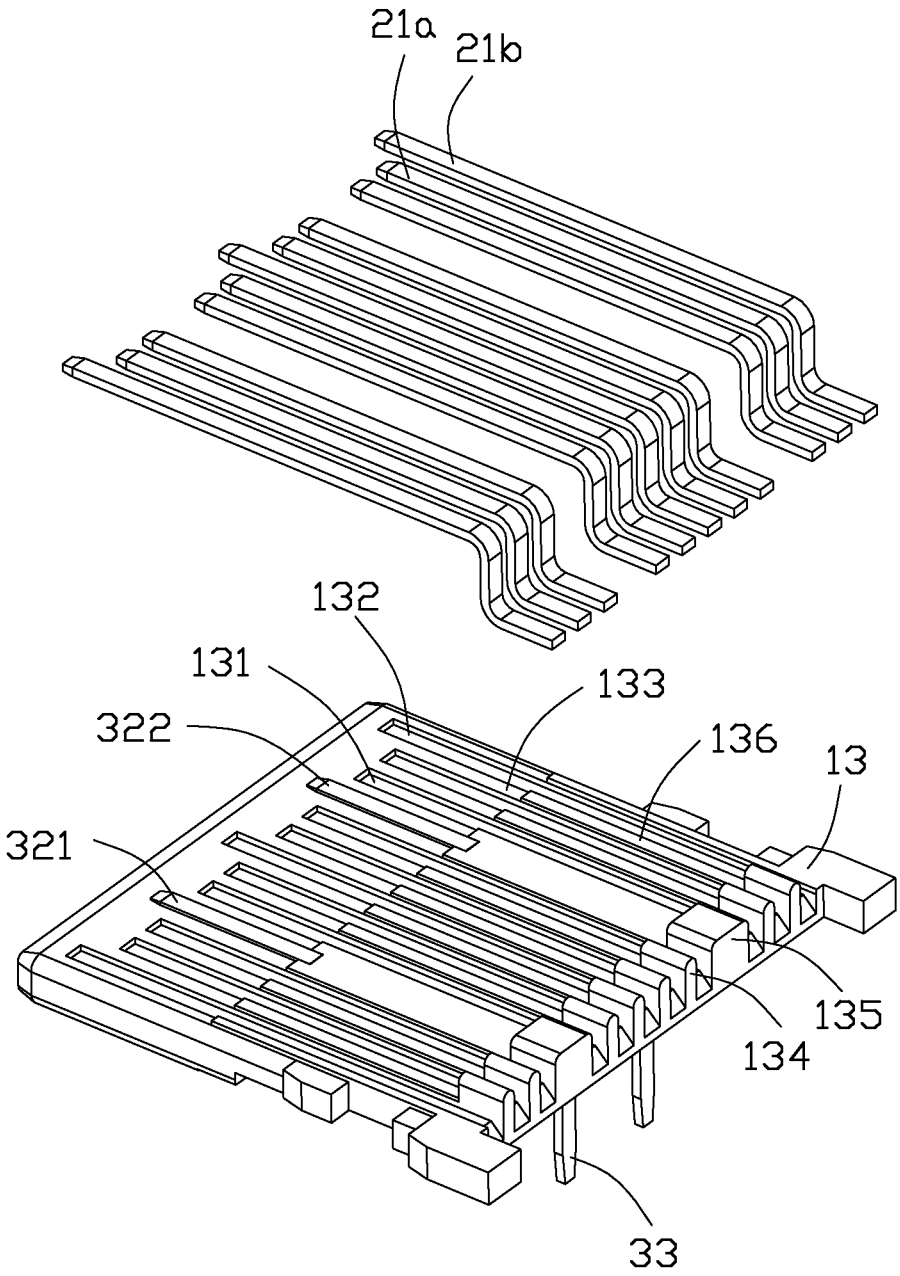
FIG. 5 is an exploded perspective view of a tongue member and an upper row of terminals of the electrical connector.
Figure 6:
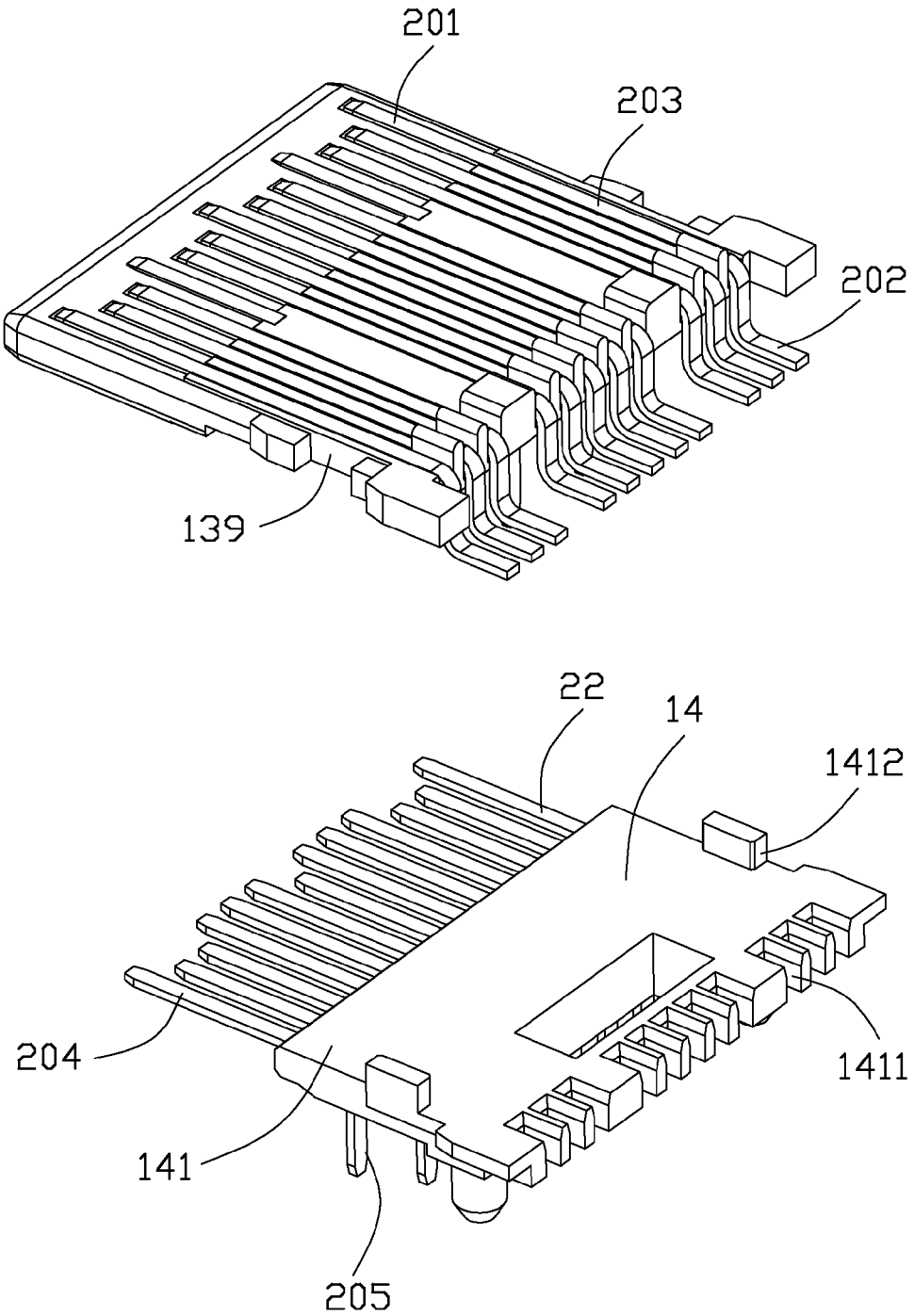
FIG. 6 is an exploded perspective view of the tongue member and a terminal module of the electrical connector.
Figure 7:
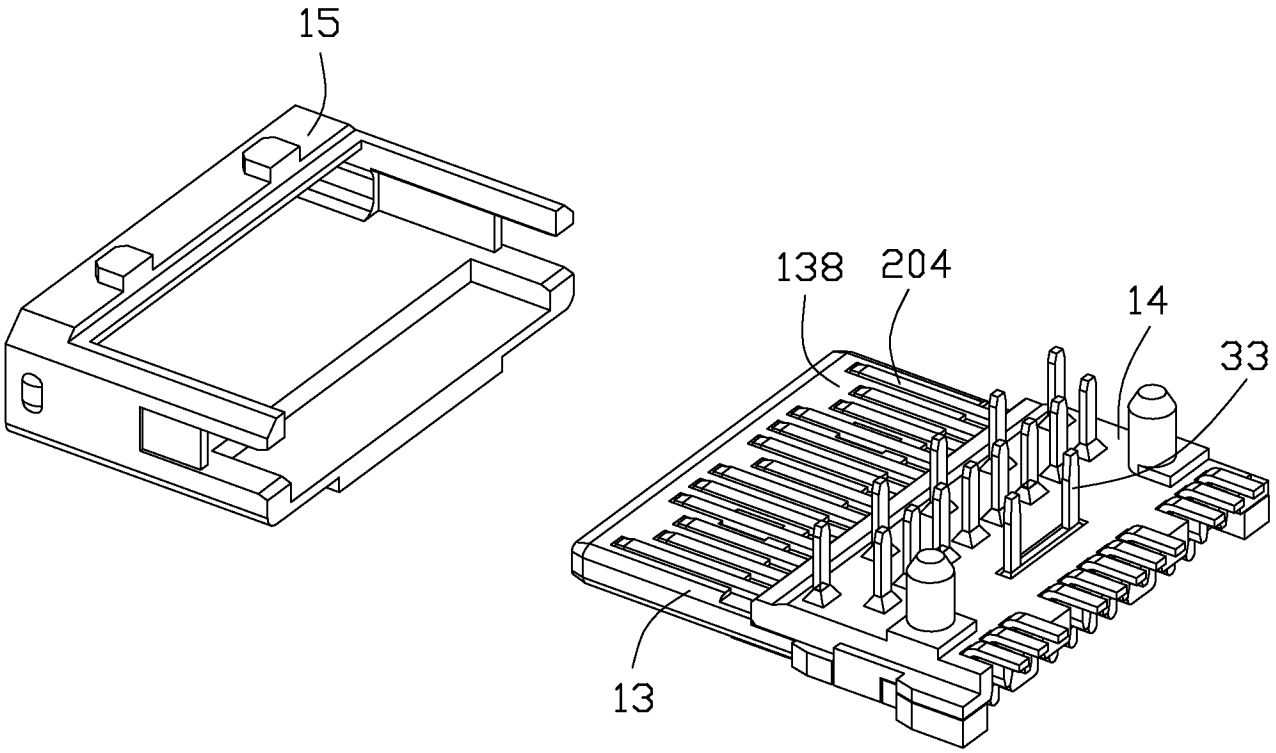
FIG. 7 is an exploded perspective view of the tongue member retained with the terminal module and an insulating housing.
Figure 8:
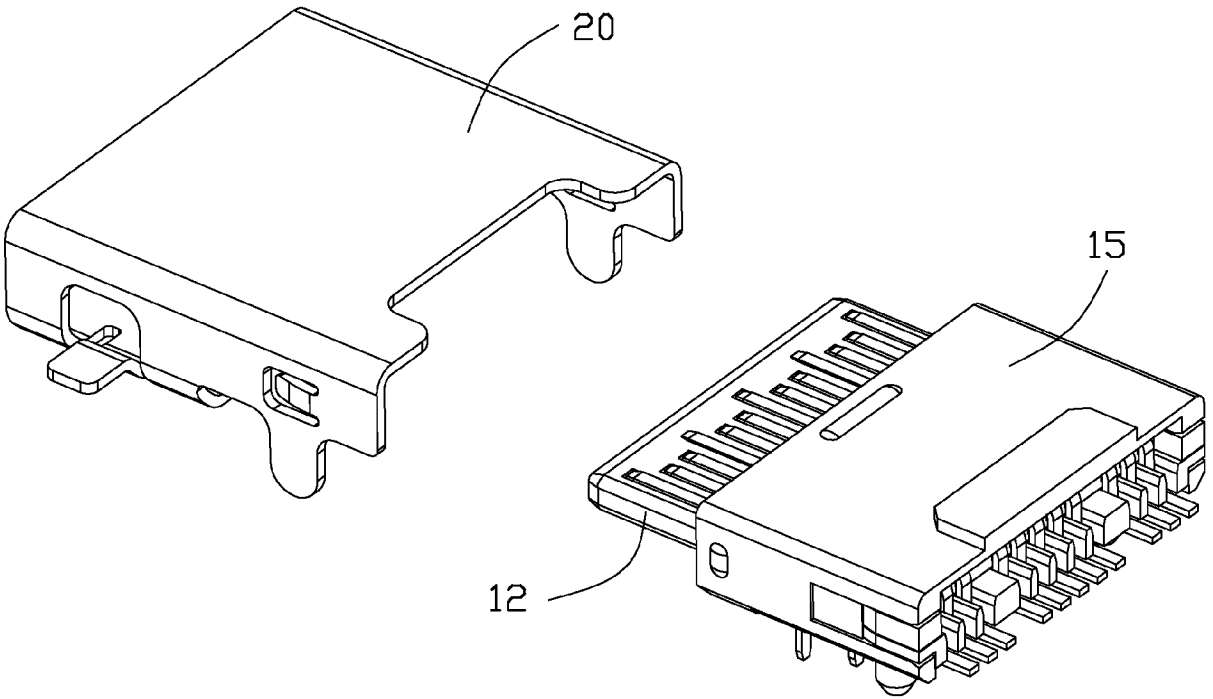
FIG. 8 is an exploded perspective view of the electrical connector.

Referring to FIGS. 1-3, an electrical connector 100 mounted upon a printed circuit board 200 is intended to mate with a cable plug connector (not shown). The electrical connector 100 includes an insulative housing 10 and a metallic shielding shell 20 retained with the housing and surrounding the housing, thereby defining a receiving cavity 11, into which a front mating tongue 12 extending forwards from a rear base 17 of the insulating housing. A plurality of first terminals 21 arranged in an upper row and a plurality of second terminals 22 arranged in a lower row are disposed at opposite surfaces of the front mating tongue 12. In this preferred embodiment of the present invention, the first and second terminals 21, 22 are in a flat-like shape. A shielding plate 30 is integrated into the design of the electrical connector 100 and disposed between the upper row and lower row of terminals 21, 22 to reduce cross-talking produced by the terminals. The shielding plate 30 comprises a main portion 31 and two fingers 321, 322 split from the main portion 31, the main portion 31 is interposed between said two rows of terminals. The upper row of terminals 21 comprises signal terminals 21*a* and grounding terminals 21*b*. Two adjacent signal terminals consist of a differential pair of signal and two adjacent differential pair are interposed with a grounding terminal 21*b*, and adjacent grounding terminals sandwich one differential pair. In this embodiment, the upper row 21 comprises four pairs of differential pair and three grounding terminals 21*b*. Please note two grounding terminals are removed and replaced with the fingers 321, 322 of the shielding plate 30, so that the fingers are functioned as grounding finger without any connecting legs. Understandably, the grounding terminals are replaced by the grounding finger one by one. Description of the electrical connector 100 will be given hereinafter.

As shown in FIG. 4 through FIG. 8 showing an assembling of the electrical connector 100 in sequence, the shielding plate 30 is punched from a metal sheet, the grounding fingers 321, 322 extend parallel to the main portion 31 and a grounding leg 33 bending downwards from a rear edge of the main portion 31. The grounding leg 33 is in a fork shape. The shielding plate 30 is integrally molded with a tongue member 13, thereby the shielding plate 30 being embedded in the tongue member 30 and the grounding fingers 321, 322 extending along an upper face 133 of the tongue member 13. The connecting leg 33 extends through the bottom of the tongue member 13. The tongue member 13 further defines a plurality of short grooves 131 and longer grooves 132 at the upper face 133 thereof, the grooves 131, 132 running through a rear end of the tongue member and partitioned by corresponding ribs 134. The tongue member 13 rises two boss portions 135 aligned with the grounding fingers 321, 322. The upper row of first terminals 21 are assembled into the grooves 131, 132 in a condition that the signal terminals are accommodated in the short grooves 131 and the grounding terminals 21*b* are accommodated in the longer grooves 132. The first terminals 21 comprise contacting portions 201 loaded in the front tongue portion 12/the front portion of the tongue member 13 and connecting legs 202 extending downward and middle portions 203 connecting with the contacting portions and the connecting legs. Please notes, the grounding fingers 321, 322 only provide contacting portions, there is no connecting legs aligned with the grounding fingers. In this embodiment, the upper face 133 of the tongue member 13 defines higher partitioning ribs 136 between every two adjacent grooves 131, 132, the higher partitioning ribs 136 discontinue at roots of the grounding finger 321, 322 from the main portion 30.

The lower row of second terminals 22 is molded with a terminal module 14. The terminal module 14 comprises an insulator 141. The terminals 22 comprise contacting portions 204 extending forwards from a front of the insulator 141 and connecting legs 205 extending downward from a bottom face of the insulator 141. The insulator 141 has partitioning grooves 1411 along a rear end thereof. The tongue member 13 and the terminal module 14 are assembled together and interlocking with each other. The contacting portions 204 of the terminal module 14 are accommodated in the grooves defined on a lower surface 138 of the tongue member 13. The terminal module 14 has locking arms 1412 interlocking with locking recesses 139 on the tongue member 13. The connecting legs 202 of the upper row run through the partitioning grooves 1411.

The tongue member 13 with the terminal module 14 is then commonly forwardly inserted into an insulating base 15, the front portion of the tongue member 13 extends from the insulating base 15 to be served as the front mating tongue 12. Then, the shielding shell 20 is retained on the insulating base 15 and surrounds the front mating tongue 12 of the housing, completing an I/O connection interface.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a plug and mounting to a printed circuit board, comprising:

an insulative housing defining a rear base and a front mating tongue;

two rows of terminals received in the insulating housing, said terminals comprising contacting portions exposed upon opposite surfaces of the front mating tongue and board-connecting legs extending out of the rear base for mounting to the printed circuit board;

the terminals categorized with differential pairs of signal and grounding terminals mixed up with one another for coupling to the plug;

a shielding plate interposed between said two rows of the terminals, the shielding plate including at least one grounding finger split therefrom and a grounding leg for mounting to the printed circuit board;

wherein each of the at lease one grounding finger is disposed between two adjacent differential pairs and parallel to the contacting portions of said terminals.

2. The electrical connector as described in claim 1, wherein the insulating housing comprises a tongue member and the shielding plate is embedded in the tongue member, the at least one grounding finger extend in a first face of the tongue member and a first row of said two rows of terminals is arranged along the first face of the tongue member.

3. The electrical connector as described in claim 2, wherein the insulating housing comprises a terminal module, a second row of said two rows of terminals is integrally molded with the terminal module, the tongue member and the terminal module interlock with each other.

4. The electrical connector as described in claim 3, wherein the contacting portions of the second row of terminals extend from the terminal module and are accommodated in a second face of the tongue member opposite to the first face of the tongue member.

5. An electrical connector comprising:

an insulative housing;

a row of first terminals loaded in the insulating housing, each first terminal comprising a contacting portion, a connecting leg and a middle portion connecting with the contacting portion and the connecting leg;

a shielding plate disposed at one side of the row of first terminals, the shielding plate defining a grounding leg and at least one grounding finger;

wherein the at least one grounding finger is arranged into the row of first terminals so that the at least one grounding finger and the contacting portions of the first terminals are arranged in a grounding-signal-signal-grounding pattern.

6. The electrical connector as described in claim 5, comprising a row of second terminals is disposed at an opposite side of the row of first terminal, each the second terminal comprising a contacting portion, a connecting leg and a middle portion connecting with the contacting portion and the connecting leg.

7. The electrical connector as described in claim 6, wherein the shielding plate is embedded in the insulating housing.

8. The electrical connector as described in claim 6, wherein the insulating housing comprises an insulating base, a tongue member and a terminal module interlocking with the tongue member, the tongue member and the terminal module are commonly retained in the insulating base and a shielding shell retained at the insulating base and surrounding a front tongue portion of the tongue member to define a mating cavity, the second terminals are integrally molded with the terminal module.

9. An electrical connector for mounting to a printed circuit board, comprising:

an insulative tongue member defining opposite first and second mating surfaces thereon in a vertical direction;

a terminal module assembled to the tongue member and including an insulator associated with a plurality of first row terminals having first contacting sections forwardly extending beyond the insulator and exposed upon the first mating surface;

a plurality of second row terminals having corresponding second contacting sections exposed upon the second mating surface; and a horizontally extending metallic shielding/grounding plate defining a planar configuration received in a middle level of the tongue member; wherein said shielding/grounding plate includes unitarily a grounding finger extending offset from said planar configuration toward at least one of said first mating surface and said second mating surface.

10. The electrical connector as claimed in claim 9, wherein said grounding finger is exposed upon said one of the first mating surface and said second mating surface.

11. The electrical connector as claimed in claim 9, wherein said shielding/ground plate is integrally formed within the tongue member via an insert molding process.

12. The electrical connector as claimed in claim 9, wherein said tongue member is configured to allow said second row terminals to be assembled thereto in only the vertical direction.

13. The electrical connector as claimed in claim 9, wherein said shielding/grounding plate includes a mounting leg extending downwardly in the vertical direction for mounting to the printed circuit board.

14. The electrical connector as claimed in claim 9, wherein said tongue member defines a rear portion overlapped with the insulator in the vertical direction.

15. The electrical connector as claimed in claim 14, wherein the insulator defines a bottom surface for confronting the printed circuit board while a bottom surface of the rear portion of the tongue member seated upon the insulator.

16. The electrical connector as claimed in claim 15, further including a metallic shell enclosing a front portion of the tongue member to form a mating port for mating with a plug, wherein a bottom wall of the shell is lower than the bottom surface of the insulator for compliantly reception within a notch of said printed circuit board.

17. The electrical connector as claimed in claim 16, wherein tails of the first row terminals extend in the vertical direction while those of the second row terminals extend horizontally.

18. The electrical connector as claimed in claim 16, further including an insulative housing located between the shell and the assembled tongue member and insulator.

19. The electrical connector as claimed in claim 9, wherein the first row terminals are integrally formed within the insulator via an insert molding process.

20. The electrical connector as claimed in claim 9, wherein both said tongue member and said insulator define partitioning grooves to regulate tails of the second row terminals for mounting to the printed circuit board.

* * * * *